United States Patent [19]

Sanvito et al.

[11] 4,149,478

[45] Apr. 17, 1979

[54] CONTROL DEVICE FOR A CHAIN OF STITCHES IN A SEWING MACHINE

[75] Inventors: Roberto Sanvito, Milan; Giancarlo D. Torre, Biassono, both of Italy

[73] Assignee: Rockwell-Rimoldi, S.p.A., Milan, Italy

[21] Appl. No.: 872,973

[22] Filed: Jan. 27, 1978

[30] Foreign Application Priority Data

Feb. 2, 1977 [IT] Italy ..... 19865 A/77

[51] Int. Cl.[2] ..... D05B 65/06

[52] U.S. Cl. ..... 112/286; 112/287; 112/288; 112/DIG. 1

[58] Field of Search ..... 112/286, 287, 288, DIG. 1

[56] References Cited

U.S. PATENT DOCUMENTS

| | | | |
|---|---|---|---|
| 2,450,043 | 9/1948 | Haas | 112/DIG. 1 UX |
| 2,988,031 | 6/1961 | Reid | 112/286 X |
| 3,123,033 | 3/1964 | Weigert | 112/288 X |
| 3,490,403 | 1/1970 | Boucraut | 112/287 |

FOREIGN PATENT DOCUMENTS

| | | | |
|---|---|---|---|
| 1710917 | 4/1970 | Fed. Rep. of Germany | 112/286 |
| 2437192 | 11/1975 | Fed. Rep. of Germany | 112/287 |

*Primary Examiner*—Wm. Carter Reynolds

[57] ABSTRACT

A device for orienting a chain of stitches severed from a completed workpiece to a position where the severed chain will be taken and sewn with the initial stitches into the seam formed on the following workpiece.

3 Claims, 4 Drawing Figures

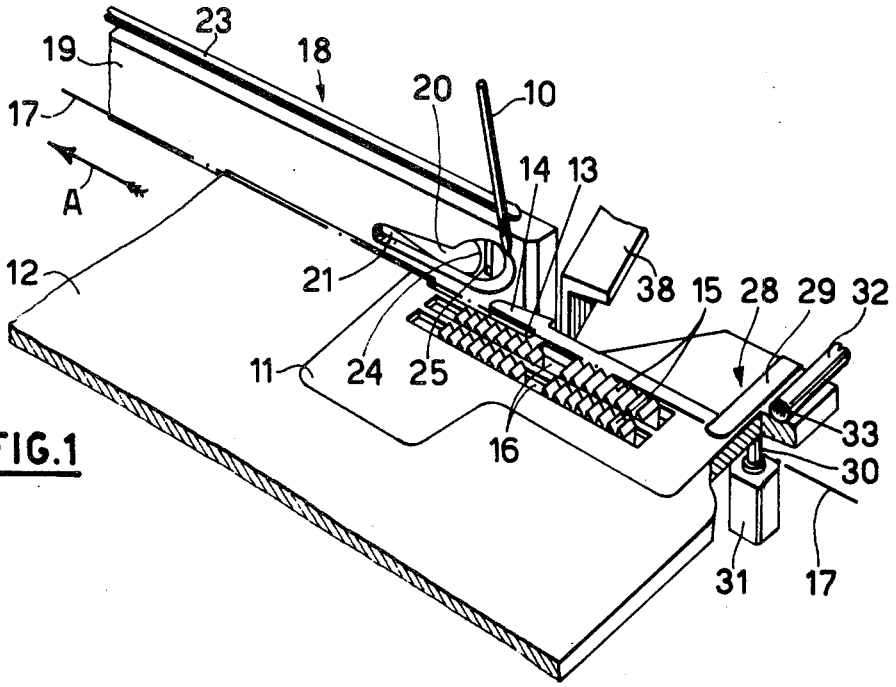
FIG.1
FIG.2
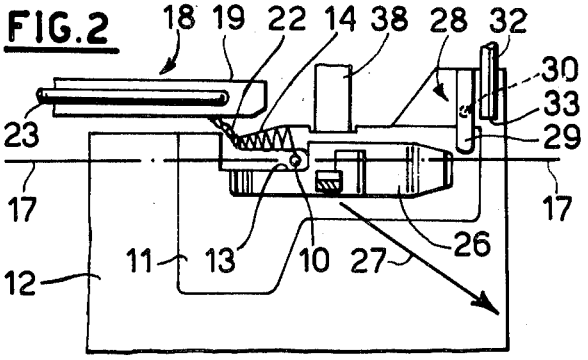
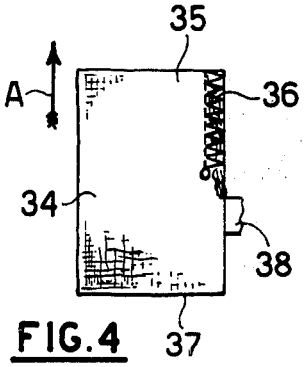
FIG.4
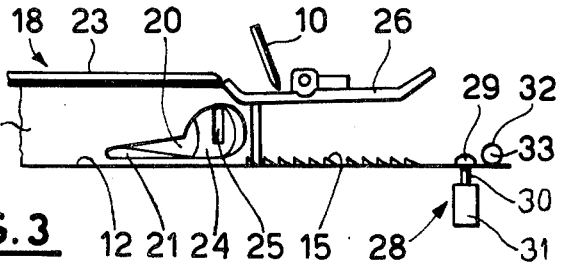
FIG.3

CONTROL DEVICE FOR A CHAIN OF STITCHES IN A SEWING MACHINE

BACKGROUND OF THE INVENTION

The present invention pertains to a device for use on a sewing machine to automatically orient a chain of stitches and hold the same in a position forward of the presser foot so that said chain will be sewn into the seam to be formed on the next piece of material to be stitched. As is well known, sewing machines that are adapted to sew a seam on a succession of pieces of material--for example, an edge of the type numbered 501 in the Federal Standard Catalog (U.S.A)-- the stitches continue to be formed in the area between successive pieces of material, and means are provided for detaching the pieces of material one from the other by automatic chain-cutting devices after the pieces have traveled beyond the presser foot of the machine.

Separation of the pieces in this manner causes a chain of stitches to remain on the leading edge of each piece of material which must be folded and sewn into the seam being formed on said piece of material so as not to detract from the finished appearance of the workpiece and to prevent the stitches from loosening or unraveling.

The function of folding the chain into the seam being sewn on a piece of material is well known, however, the devices available for this purpose all have the drawback of not providing a positive means for the complete insertion of the chain into a new seam, as well as not permitting the initial stitches to be tightened, owing to the fact that the chain is held prior to cutting exclusively by pneumatic means. On the other hand the known devices that are adapted to function manually are provided with mechanical elements which effect positive and complete insertion of the chain into a new seam and the desired thickening of the initial stitches. These devices, however, have what is considered a definite drawback for they require the direct intervention of a machine operator, who (1) must be certain that the piece of material that has just been sewn and the chain of stitches that still binds it to the machine are brought into contact with the elements that will cut the chain and grasp it so as to position it for the next seam to be sewn, and (2) must detach the finished piece of material.

However, the known manual devices cannot be used in combination with any type of automatic chain cutter, and therefore cannot be used in machines that operate automatically.

An object of the present invention is to eliminate the above-mentioned drawbacks and to provide an automatic means for effecting positive and complete insertion of the chain into the seam being sewn and to obtain a thickening of the stitch in the first part of the new seam.

To accomplish this, the elements of the present invention are adapted to orient the chain of stitches and to maintain it in the proper position at the beginning of the seam. The invention is adapted to be utilized in a sewing machine having the usual stitching instrumentalities which include one or more needles, a feed mechanism that defines the sewing axis, a needle plate provided with a tongue on which the chain of stitches is formed, and an automatic chain cutter located adjacent to the needle plate.

SUMMARY OF THE INVENTION

The device according to the invention includes a chain blower, located beyond the stitching instrumentalities and to the right of said sewing axis. The blower forces compressed air in the direction of the needle, and at an angle that intersects said sewing axis so as to direct a stream of air on the chain as it is pulled into and stretched within the chain cutter.

A mechanical chain gripping member is disposed forward of the needle and perpendicular to the sewing axis and is adapted to receive and hold the chain in a desired position.

Additionally the invention includes a chain suction device, located forwardly of and parallel to the mechanical gripping member. The intake of the suction device is disposed to the right of said sewing axis so as to draw the chain that is oriented by the blower to a position beneath the gripping member.

These and other features of the invention will become more fully apparent by reference to the appended claims and as the following detailed description proceeds in reference to the figures of drawing wherein:

BRIEF DESCRIPTION OF THE DRAWING

FIG. 1 is a perspective view of a portion of a sewing machine showing the various elements comprising the invention applied thereto;

FIG. 2 is a plan view of that portion of the sewing machine and elements shown in FIG. 1;

FIG. 3 is a view in side elevation of the sewing machine and invention shown in FIGS. 1 and 2; and FIG. 4 is a schematic view of a workpiece showing a chain of stitches locked into the seam being sewn.

DESCRIPTION OF THE PREFERRED EMBODIMENT

Referring now to FIG. 1, the device according to the invention for orienting a chain of stitches and holding it in position at the beginning of a seam can be used, for example, on a sewing machine that forms an overcast stitch of the type identified by numeral 501 in the U.S. Federal Standard Catalog.

In FIGS. 1, 2 and 3 only the sewing area of a sewing machine is shown which is sufficient to serve as a basis for a detailed description of the invention applied thereto. In these figures of drawing a needle 10 is shown which is located above a needle plate 11. This needle plate 11 is mounted in a worksurface 12 of the sewing machine and as is well known is adapted to support the material or so-called workpiece to be sewn.

The needle plate 11 is provided with a slotted opening 13 through which the needle 10 is caused to pass during the performance of its intended function of penetrating the material to be sewn and operatively cooperating with the stitching instrumentalities (not shown) disposed beneath said needle plate.

One side of the opening 13 defines a tongue 14 that forms an integral part of the needle plate and on which a chain of stitches is formed as a result of continued sewing in the area intermediate each successive workpiece.

The tongue 14 extends in the direction of the indicating arrow A in FIG. 1 which is the same direction as that which the workpieces are caused to advance during the sewing operation. The pieces of material are advanced by a conventional form of feed dog 15 which in a known manner travels in an eliptical pathway so as to periodically project above elongated slots 16 formed in the needle plate 11. The combination of the movements of the stitching instrumentalities and those of the feed mechanism defines the sewing axis 17 which is parallel with the indicating arrow A. The pieces of material and the seam that is sewn on them are caused to advance along this axis.

Adjacent to the needle plate 11 and parallel with the sewing axis 17 a well-known type of automatic chain-cutting device 18 is mounted that consists essentially of a suction tube 19 adjacent to the tongue 14. The suction tube 19 is provided with an opening 20 within which a blade 21 is assembled and which defines a chain cutter that is caused to function in a known manner.

Referring now to FIG. 2, the series of linked stitches that are formed on the tongue 14 results in a chain 22 that is caused to enter the tube 19 and to be cut by the blade 21 in the usual manner. The chain cutter also includes a compressed air conduit 23 (FIGS. 1 and 3) that is disposed parallel and in close proximity with the pathway along which the workpieces are caused to travel. This compressed air conduit 23 has a blower 24 at one end thereof which is located within the tube 19 near the aperture 20 and spaced from the needle 10.

The blower 24 is disposed rearwardly of the needle 10 and is provided with a nozzle 25 that directs a stream of air onto the chain of stitches 22. This nozzle 25 defines a rectangular opening and is disposed at a sufficient distance above the needle plate 11 so that the compressed air emitted therefrom will not engage the top of the teeth of the feed dog 15. The nozzle 25 is of sufficient height so as to occupy the space between the needle plate and the presser foot 26 of the sewing machine (FIG. 3), when said presser foot is in its raised position at the end of the sewing cycle.

The particular location of the nozzle 25 is necessary so as to prevent the compressed air leaving the nozzle from striking the sides of the presser foot. Lastly, the nozzle 25 is disposed so as to direct the flow of air therefrom toward the forward portion of the sewing machine in a direction 27 that will intersect the sewing axis 17 and that will cause air to flow about the needle 10. Forward of the needle 10 and the presser foot 26 the machine is provided with a mechanical chain gripping device 28 which includes a movable blade 29 that is disposed perpendicular to the sewing axis 17 and which is adapted to receive and grip the chain 22 in a manner that will be more fully described hereinafter.

To facilitate the insertion of the chain between the worksurface 12 and the movable blade 29, the latter is controlled by its operative association with an actuating rod 30 of a pneumatic cylinder 31. When this cylinder is activated one end of the blade 29 is raised above the worksurface 12.

The machine also includes a chain-suction device 32 which is located forwardly of the gripping device 28 and defines a conduit that extends parallel to the blade 29. The intake end of the chain-suction device is identified by numeral 33 and is disposed adjacent to the sewing axis 17.

More precisely, this intake end 33 is disposed in close proximity with the actuating rod 30 and as shown in FIG. 2 is laterally spaced from the sewing axis 17 so that when the blade is raised it functions as a limiting device for the chain passing beneath said blade.

OPERATION

During the sewing of a seam on a piece of material 34 (FIG. 4) the latter is advanced beneath the presser foot 26 by the feed dog 15 in the direction of the indicating arrow A.

During this movement the leading edge 35 of the material is engaged by the needle 10 which in a known manner commences to form a seam 36 that coincides with the sewing axis 17.

Upon completion of the seam on a piece of material, the trailing edge 37 approaches the opening 20 of the cutting device 18 and the chain of stitches 22 formed between said trailing edge 37 and on the tongue 14 as the piece of material moves away from the needle 10, is pulled in and cut at the edge of the material so as to release the sewn piece. The remaining chain of stitches that is formed before a cessation of machine operation is drawn into the tube 19 while passing in front of the nozzle 25.

When the presser foot 26 is raised to a position above the needle plate 11 to facilitate positioning of the next piece of material to be sewn the suction in the tube 19 of the chain cutting device is cut off and, at the same time, a brief stream of air is emitted from the nozzle 25.

Because the sewing machine is normally shut down when its needle is in the elevated position, the threads forming the chain of stitches become loosened, to the extent whereby the suction produced within the tube 19 is sufficient to withdraw the chain from the tongue 14.

The above-mentioned stream of air from the nozzle 25 ejects the free end of the chain 22 from the chain cutter and temporarily orients it so that it extends about the needle 10 and thence in the direction of the indicating arrow 27 shown in FIG. 2.

The stream of air from the nozzle 25 has a configuration that is substantially conical which causes the lower part therefor to strike the teeth of the feed dog 15 while the upper part strikes against the underside of the presser foot 26 to reflect the same downwardly towards a position spaced from said feed dog. With the stream of air being controlled in this manner, rotation of the chain occurs on a plane above that on which the teeth of the feed dog 15 are located, and is effective in preventing the chain from becoming entangled in said teeth and also prevents the free end of said chain from being pulled downwardly beyond the feed dog to a position where it would be affected by the suction device 32.

At this point, the chain 22 is drawn by the suction device which has remained in operation during the raising of the presser foot 26.

The pneumatic cylinder 31 is activated at the same time as the suction device, and it raises the blade 29 from the worksurface so as to allow the chain disposed beneath said blade 29 to be drawn into the intake end 33 under maximum tension.

When the stream of air from the nozzle 25 is turned off, the pneumatic cylinder 31 that controls the lowering of the blade 29 and the subsequent gripping of the chain 22 is also turned off. Because of their specific locations, the gripper and suction devices position the chain 22 at an angle oblique to the sewing axis 17. In this position, the chain is very close to a conventional trimmer knife 38 that is mounted on the sewing machine, and comes into contact with it.

When a new piece of material is inserted beneath the presser foot, a new sewing cycle begins.

In this way, the new piece of material is advanced, thereby overcoming the resistance of the chain held by the blade 29.

This resistance results in a thickening of the initial stitches on the leading edge 35, and provides for positive insertion of the chain into the new seam being sewn and the locking of same therein.

Lastly, the angular position assumed by the chain causes said chain to contact a trimmer knife 38 that is effective in substantially shortening it so that it will be completely covered by the seam of stitches.

The cut portion of the chain is disposed of by the suction device 32 as soon as the blade 29 is once again lifted.

In this manner the complete insertion of a short length of the free end of the chain into the new seam and the prevention of possible unraveling is achieved.

In the preferred embodiment described above, the blower 24 is located within the tube 19 so as to reduce the possibility of obstructions, but it is obvious that it could also be located outside said tube in whatever position desired beyond the needle, but at a distance from the needle such that the blowing action would produce the momentum necessary to turn the chain past the needle.

Additionally, the blower could be provided with one or more nozzles of different shape from the one described above without exceeding the framework of the present invention.

Although the present invention has been described in connection with a preferred embodiment, it is to be understood that modifications and variations may be resorted to without departing from the spirit and scope of the invention and the appended claims.

We claim:

1. A device for controlling a chain of stitches when starting a seam in a sewing machine of the type having at least one stitch forming needle and feed mechanism defining the sewing axis and a needle plate with an integral tongue on which the chain of stitches is formed with a chain cutter mounted adjacent the needle plate for receiving the chain formed on the tongue, said controlling device comprising:

(a) a blower (24) mounted on the machine rearwardly of the needle and feed mechanism and to the right of the sewing axis for directing a stream of air toward the needle at an angle to intersect the sewing axis for reorienting and removing the chain from the chain cutter;

(b) a chain gripping device (28) mounted on the machine forwardly of the needle; and (c) a chain suction device (32) assembled adjacent and parallel to said gripping device (28) which includes;

(i) an intake end (33) disposed to the right of the sewing axis for receiving the chain reoriented by said blower (24) and presenting the same to said gripping device (28).

2. The device according to claim 1 wherein said blower (24) includes a vertically extending rectangular shaped nozzle (25) disposed within the chain cutter.

3. The device according to claim 1 wherein said chain gripping device (28) defines a movable blade (29) pivotable by pneumatic means between positions for receiving, gripping and releasing the chain upon reception of the chain by said chain suction device (32).

* * * * *